US008015811B2

(12) United States Patent
Tyler et al.

(10) Patent No.: US 8,015,811 B2
(45) Date of Patent: Sep. 13, 2011

(54) METHOD AND APPARATUS FOR VARYING FLOW SOURCE TO AID IN WINDAGE HEATING ISSUE AT FSNL

(75) Inventors: Karen J. Tyler, Burnt Hills, NY (US); Nestor Hernandez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 422 days.

(21) Appl. No.: 12/318,956

(22) Filed: Jan. 13, 2009

(65) Prior Publication Data

US 2010/0175378 A1 Jul. 15, 2010

(51) Int. Cl.

| | |
|---|---|
| ***F01K 7/42*** | (2006.01) |
| ***F01K 13/02*** | (2006.01) |
| ***F01K 9/00*** | (2006.01) |
| ***F01K 21/06*** | (2006.01) |
| ***F04D 29/00*** | (2006.01) |

(52) U.S. Cl. ..... 60/666; 60/660; 60/661; 60/646; 415/169.1

(58) Field of Classification Search ..... 60/645–681; 415/169.1–169.4

See application file for complete search history.

(56) References Cited

U.S. PATENT DOCUMENTS

| | | | | |
|---|---|---|---|---|
| 4,309,873 | A * | 1/1982 | Koran et al. | 60/646 |
| 4,353,216 | A * | 10/1982 | Dickenson | 60/662 |
| 4,519,207 | A * | 5/1985 | Okabe et al. | 60/39.182 |
| 4,576,008 | A * | 3/1986 | Silvestri, Jr. | 60/662 |
| 4,957,410 | A * | 9/1990 | Silvestri, Jr. | 415/169.1 |
| 5,435,138 | A * | 7/1995 | Silvestri, Jr. | 60/652 |

* cited by examiner

*Primary Examiner* — Thomas E Denion
*Assistant Examiner* — Christopher Jetton
(74) *Attorney, Agent, or Firm* — Nixon & Vanderhye, PC

(57) ABSTRACT

A method and apparatus are disclosed for alleviating the problem of windage heating when flow, in a turbine running at full speed, no load, decreases greatly at the exhaust of the high pressure sections of the turbine. Valves connecting the different pressure levels of a heat recovery steam generator to the input of the turbine are adjusted to mix steam coming from the different pressure levels to create desired steam conditions at the inlet and the exhaust output of the turbine that allow the use of existing steam path hardware and thereby reduce the cost of such piping. In an alternative embodiment for a single pressure HRSG, high pressure saturated steam is extracted from the HSRG evaporator and then flashed into superheated steam when passing thru a control valve, that is then used to create the desired steam conditions at the inlet and the exhaust output of the turbine.

20 Claims, 3 Drawing Sheets

METHOD AND APPARATUS FOR VARYING FLOW SOURCE TO AID IN WINDAGE HEATING ISSUE AT FSNL

The present invention relates to steam turbines, and more particularly, to a method and apparatus for eliminating high steam temperatures due to windage heating at the exhaust of the turbine when running at full speed, no load.

BACKGROUND OF THE INVENTION

A heat recovery steam generator ("HRSG") is a heat exchanger that recovers heat from a hot gas stream. It produces steam that can be used in a process or used to drive a steam turbine. A common application for an HRSG is in a combined-cycle power station, where hot exhaust from a gas turbine is fed to an HRSG to generate steam which in turn drives a steam turbine. HRSGs often consist of three sections: an LP (low pressure) section, a reheat/IP (intermediate pressure) section, and an HP (high pressure) section. Each section has a steam drum and an evaporator section where water is converted to steam. This steam then passes through superheaters to raise the temperature and pressure past the saturation point. "Low pressure" can be defined, for example, as a pressure that is less than, equal to, or not greatly above, atmospheric pressure, while "high pressure" can be defined, for example, as a pressure that greatly exceeds atmospheric pressure. "Intermediate pressure" would then be a bewteen these two levels.

FIG. 1 is a schematic drawing of a prior art double flow, high pressure ("HP"), non-condensing ("DFNC") turbine 10 with multiple stages (not shown). Turbine 10 includes a casing 11 with an inlet 22, two high pressure sections 13 and 15, and two exhaust outputs 12 and 14. Connected to turbine 10 is a two-level heat recovery steam generator ("HRSG") 16 with a high pressure section 18 and an intermediate pressure section 20. As is typical with heat recovery steam generators, HRSG 16 recovers heat from a hot gas stream (not shown) and generates steam that is used to drive steam turbine 10. This steam is fed into turbine 10 through inlet 22, which is connected to HRSG 16 through pipe line 23.

Turbine 10 has a very high temperature at its inlet 22 and an exhaust temperature of about the same value at its exhaust outputs 12 and 14, when running at full speed, no load ("FSNL"). The exhaust outputs 12 and 14 are connected to a valve 24 through pipe line 25. The exhaust pressure is controlled by valve 24 and set at a constant value.

Typical turbine conditions will depend on the needs of the customer using the turbine. Thus, for example, where turbine 10 is used in a desalination plant application, it might have an inlet temperature of about 1015° F., an exhaust temperature of about 980° F., an exhaust pressure of about ~40-50 psia (pounds-force per square inch absolute, i.e., gauge pressure plus local atmospheric pressure) and a pressure drop between inlet and exhaust at full load of approximately 1400 psia to 40 psia, resulting in a large expansion line. The expansion line is a thermodynamic measure of the turbine efficiency for a given pressure ratio. The biggest delta in energy between inlet and exhaust conditions is the highest efficiency. Each design is optimized for a given pressure ratio. When a different pressure ratio is applied, the efficiency is not optimum anymore. The worse case is FSLO. At this load, the pressure ratio and expansion line are reduced to its minimum and the efficiency is the lowest (i.e., the inlet and exhaust energies are about the same). This results in high temperatures from inlet to exhaust. The "process steam" exiting exhaust outputs 12 and 14 is typically used in a process of some sort operated by a customer connected to valve 24 by a further pipe line 27.

Also connected to pipe line 27 is a pipe line 21 that is connected to intermediate pressure section 20 of HRSG 16. Line 21 is used in a customer process, and thus, it is not used to produce power in the steam turbine 10. There are certain desalination plants that require accurate steam condition into the process, steam turbine exhaust conditions can vary a lot from its expected conditons due to manufacturing, installation, operation, etc. Line 21, in this particular case, is used to achieve certain conditions by mixing with steam exhaust flow at full load or normal operation. During FSNL, line 21 is not required for the desalination process (the desalination process is established at higher loads), and can be used as "cooling" into the steam turbine inlet. A lower inlet temperature drives a lower exhaust temperature, as compared against HP steam. Both stean productions (HP and IP) are available during FSNL.

When turbine 10 runs at full speed, no load, the flow of steam decreases greatly at the exhaust outputs 12 and 14 of HP sections 11 and 13, and pressure begins to feed back to the up-front stages within turbine 10. As a result of this feed back of pressure, the up-front stages of turbine end up being at about the same pressure as the exhaust outputs 12 and 14 (i.e., ~40 psia), and thus, no flow of steam occurs throughout turbine 10. Only windage heating occurs due to the extremely short expansion line so that the stages of turbine 10 become exposed to high temperatures and possible hardware damage from such high temperatures.

BRIEF DESCRIPTION OF THE INVENTION

In an exemplary embodiment of the invention, an apparatus for reducing, at the exhaust of a turbine, high steam temperatures due to windage heating when the turbine is running at full speed, no load, is comprised of the turbine comprising an inlet, and an exhaust output, a heat recovery steam generator with at least one source of producing steam having a first pressure lower than a second pressure of steam within the turbine when the turbine is experiencing windage heating when running at full speed, no load, the source of steam production being connected to the turbine inlet, and at least one flow control apparatus that is adjustable to control the flow of steam to the turbine inlet from the at least one source of steam production, the at least one apparatus being adjusted to input the first lower pressure steam into the turbine inlet to thereby create first steam conditions at the turbine inlet that are lower in pressure and temperature than second steam conditions at the turbine exhaust output to thereby reduce high steam temperatures due to windage heating at the turbine exhaust output.

In another exemplary embodiment of the invention, a apparatus for reducing, at the exhaust of a turbine, high steam temperatures due to windage heating when the turbine is running at full speed, no load, is comprised of the turbine including a casing comprising an inlet, at least one high pressure section with at least one stage, and at least one exhaust output, a heat recovery steam generator with at least one source of producing steam having a first pressure lower than a second pressure of steam within the turbine when the turbine is experiencing windage heating when running at full speed, no load, the source of steam production being connected to the casing inlet, and at least one valve that is adjustable to control the flow of steam to the casing inlet from the at least one source of steam production, the at least one valve being adjusted to input the first lower pressure steam into the casing inlet to thereby create first steam conditions at the casing inlet that are lower in pressure and temperature than second steam conditions at the casing exhaust output to thereby reduce high steam temperatures due to windage heating at the casing exhaust output.

In a further exemplary embodiment of the invention, a method of reducing high temperatures due to windage heating at the exhaust of a turbine when the turbine is running at full speed, no load, is comprised of the steps of providing a turbine comprised of an inlet and an exhaust output, providing a heat recovery steam generator with at least one source of producing steam having a first pressure lower than a second pressure of steam within the turbine when the turbine is experiencing windage heating when running at full speed, no load, the source of steam production being connected to the turbine inlet, providing at least one flow control apparatus that is adjustable to control the flow of steam to the turbine inlet from the at least one source of steam production, and adjusting the at least one apparatus to input the first lower pressure steam into the turbine inlet to thereby create first steam conditions at the turbine inlet that are lower in pressure and temperature than second steam conditions at the turbine exhaust output to thereby reduce high steam temperatures due to windage heating at the turbine exhaust output.

DETAILED DESCRIPTION OF THE INVENTION

The present invention alleviates the problem of high steam temperatures due to windage heating when flow in a turbine running at full speed, no load decreases greatly at the exhaust of the high pressure sections. This decrease in flow results in pressure beginning to feed back to the up-front stages, whereupon the up-front stages are then at same pressure as the exhaust and no flow occurs throughout the turbine. This causes the several stages of the turbine to be exposed to high temperatures windage cannot be eliminated, but its negative impact can be controlled by inputting lower steam temperatures. The present invention incorporates, at a system level, the use of cooler steam from an evaporator for a single pressure HRSG, or from any other source of a lower pressure steam production for a multiple pressure level HRSG, and leveraging the steam conditions out of each portion of the HRSG to align to set desired inlet and exhaust temperatures that allow the use of existing steam path hardware and thereby reduce the cost of such piping. In one embodiment of the present invention, steam is taken from another location at a lower temperature and piped into the turbine inlet.

Figure 2:
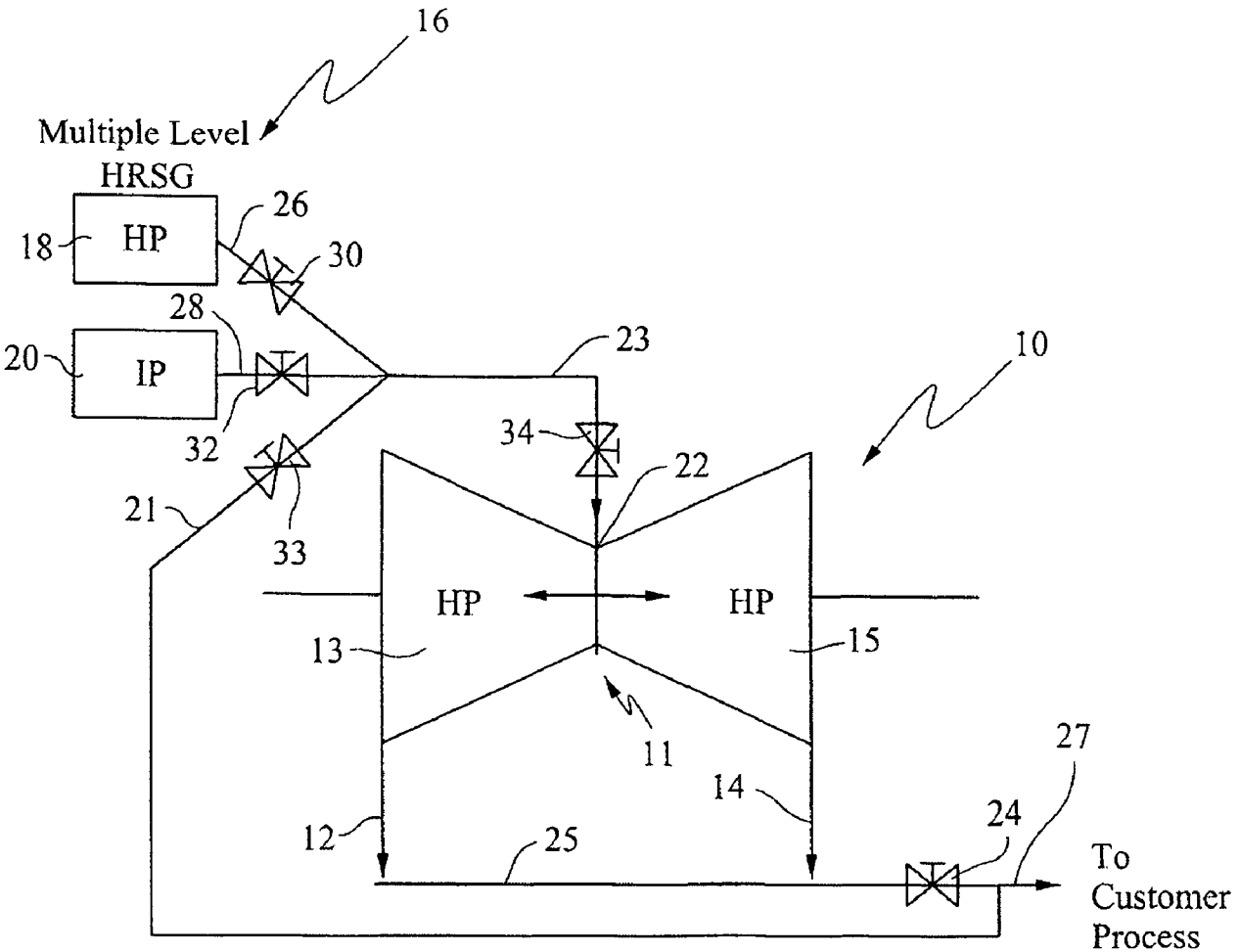
FIG. 2 is a schematic drawing of the turbine of FIG. 1 with valving to control inlet and exhaust steam conditions of the turbine.
Figure 3:
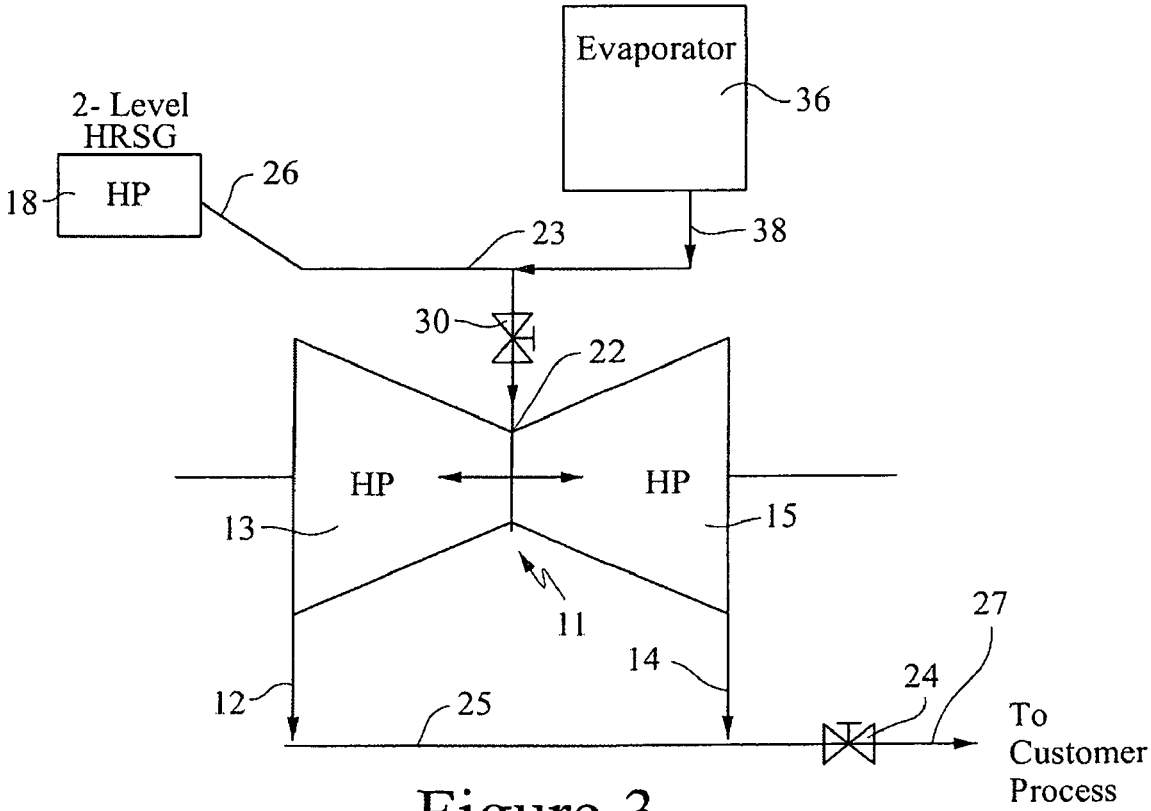
FIG. 3 is a schematic drawings of the turbine of FIG. 1 with steam being extracted from an evaporator and valving to control the steam being flashed into superheated steam.

A three pressure HRSG is mostly used for power generation. A single or two pressure level HRSG is common for desalination plants. It should be noted that the present method and apparatus for eliminating high steam temperatures due to windage heating at the exhaust of the turbine when running at full speed, no load will work for any multiple pressure level HRSG designs. Indeed, any lower pressure steam production, rather than from intermediate pressure only will work. For a single pressure level HRSG design, the steam sent to the steam turbine inlet could be extracted directly from the HRSG evaporator, with a super heater, serves the purpose of providing lower steam temperatures to the turbine inlet. FIGS. 2 and 3 illustrate two embodiments by which the present invention can be implemented.

Figure 1:
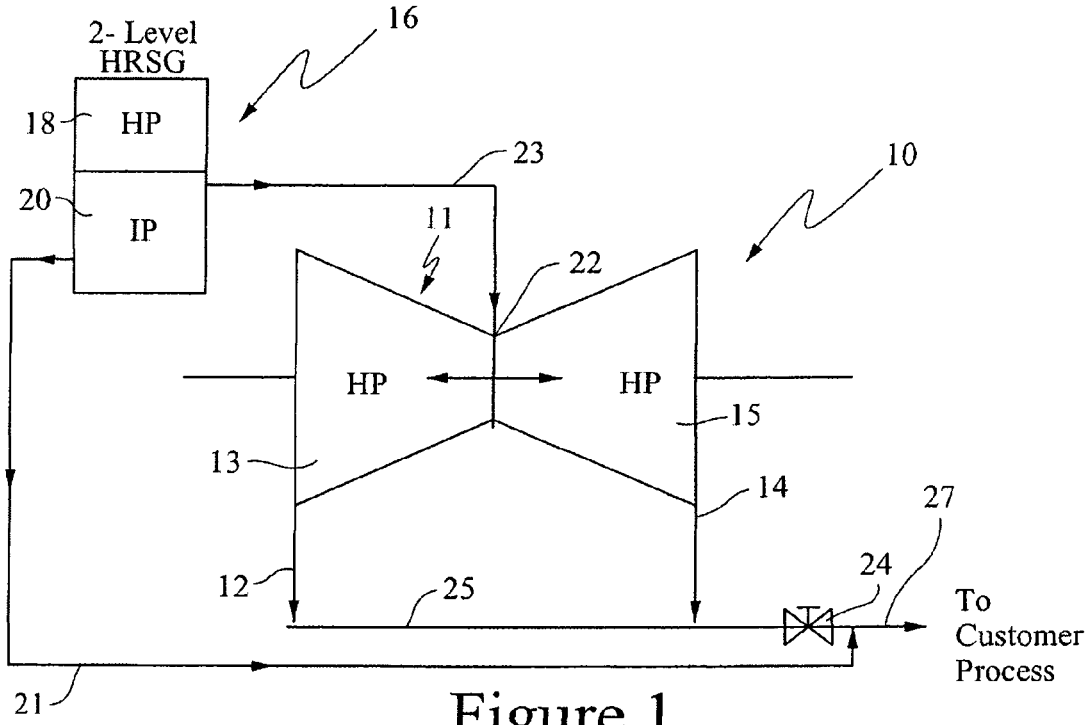
FIG. 1 is a schematic drawing of a double flow high pressure multi-stage turbine operating under a full speed no load condition that is connected to a two-level heat recovery steam generator.

As noted above, FIG. 2 is a schematic drawing of the turbine 10 of FIG. 1 operating under a full speed, no load condition, but with valves to control the inlet and exhaust conditions of the turbine. Thus, as in FIG. 1, FIG. 2 illustrates a double flow, high pressure, non-condensing turbine 10 with multiple stages. Turbine 10 includes a casing 11 with an input 22, two high pressure sections 13 and 15 and two exhaust outputs 12 and 14 connected to valve 24 through pipe line 25.

For explanation purposes only, turbine 10 is shown in FIG. 2 as being connected to a two-level HRSG 16 with high pressure section 18 and intermediate pressure section 20. It should be noted that HRSG 16 could be a multiple-level HRSG including more than two levels. In the embodiment of the invention shown in FIG. 2, the two pressure level HRSG 16 is not connected directly to turbine 10 through pipe line 23. Rather, each pressure section, 18 and 20, is connected to a separate pipe line 26 and 28, respectively, which in turn, are connected to valve 30 and 32, respectively. Thereafter, pipe lines 26 and 28 are joined to main pipe line 23, which enters turbine 10 through inlet 22. Also included in pipe line 23 is a valve 34.

Also shown in FIG. 2 is pipe line 21 re-routed from customer line 27 (downstream from the steam turbine exhaust) to the steam turbine inlet 22. Line 21 and line 28 are connected to inlet 22 through a "Y" connection, with both lines being connected to a control valve. Line 28 control valve 32 will be open from FSNL to ~10% steam turbine load, while line 21 control valve 33 will be closed. At any load higher than 10%, line 28 control valve 32 closes and line 21 control valve 33 opens.

When turbine 10 is operated at full speed, no load, valves 30 and 32 are adjusted, such that, the steam coming from high pressure and intermediate pressure sections 18 and 20 of HRSG 16 is mixed in such a way as to create required steam conditions entering turbine 10 at inlet 22. This mixing of steam coming from high pressure and intermediate pressure sections 18 and 20 allows a lower temperature steam to enter into turbine 10. The resulting steam conditions produced at inlet 22 by the mixing of steam coming from high pressure and intermediate pressure sections 18 and 20, in turn, produces favorable steam conditions at exhaust outputs 12 and 14 of turbine 10. This reduction in steam temperature results in the elimination of negative effects of windage heating at the exhaust outputs 12 and 14 of turbine 10 during full speed, no load operation. This, in turn, allows the use of carbon steel piping at exhaust outputs 12 and 14, which can result is a savings of money from the use of such piping rather than more expensive piping that would be needed to handle higher temperatures.

The temperature of water can be raised by the addition of heat energy to the water until a saturation point is reached, which is the temperature at which the water boils. At the point of boiling, the water is termed "saturated steam". If the transfer of heat to the water continues after all of the water has been evaporated, the steam temperature will rise. The steam is then called "superheated", and this "superheated steam" can be at any temperature above that of saturated steam at a corresponding pressure.

In an alternative operating condition for the embodiment of the invention shown in FIG. 2, steam from IP section 20 is flashed to superheated steam by a pressure drop to produce the desired steam conditions entering turbine 10. In this arrangement, valve 30, which is used to connect the HP pressure section 18 of HRSG 16 to pipe line 23 and inlet 22 of turbine 10, is closed. Turning off valve 30 shuts down the high pressure steam from HP section 18, thereby allowing secondary level steam from IP section 20 to pass through open valve 32 and enter turbine 10 through inlet 22. The secondary level steam from IP section 20 is then flashed to superheated steam using a superheater to produce the cooler steam conditions at the inlet 22 and subsequently at the exhaust outlets 12 and 14 of turbine 10, to thereby eliminate the negative high temperature effect of windage heating at the exhaust of turbine 10. In such a single pressure HRSG, the saturated steam flashes into superheated steam due to a pressure drop across valve 32. The steam is saturated at a certain temperature, pressure and enthalpy. When the flow passes through valve 32, the pressure drops, but the enthalpy stays the same. Having the same enthalpy at a lower pressure results in super heated steam (a higher temperature relative to the pressure). This is not the case for a multi-level HRSG. In a multi-level HRSG, superheated steam can be used at lower pressures (lower pressures mean lower temperatures, even if they are super heated).

When water boiled to produce steam. Steam used at this saturation (boiling) temperature is termed "saturated steam". In an alternative embodiment of the invention shown in FIG. 3, saturated steam is extracted from an evaporator 36, such that high pressure steam flows from evaporator 36 through piping line 38 to valve 34, after which it is then flashed into superheated steam when passing through valve 30. This is only applicable to single pressure HRSGs.

In the embodiment of FIG. 3, where evaporator extraction for a single pressure HRSG is used, both the evaporator 36 and the supper heater valve 34 are part of the HRSG. This is true for both pressure levels shown in FIG. 3, not unlike in the alternative operating condition for the embodiment shown in FIG. 2, discussed above.

Where the evaporator is part of the HRSG, each pressure level has an evaporator that takes water and change its phase to saturated steam, then the saturated steam goes through a super heater, where this saturated steam gets super heated. The evaporator embodiment applies to a single level HRSG. For a multiple level HRSG, cooler steam can be taken from the lower energy steam productions (i.e., the intermediate or low pressure levels). Thus, for a one pressure HRSG, cooler steam from the HP evaporator is used, while for a multiple pressure HRSG, superheated steam from one of the lower pressure steam productions is used.

Although FIGS. 2 and 3 show embodiments of the present invention in which a double flow, high pressure, non-condensing turbine with multiple stages is used with a two-level heat recovery steam generator, it should be understood that the present invention can be used with other types of turbine designs and heat recovery steam generators with more than two levels. While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An apparatus for reducing, at the exhaust of a turbine, high steam temperatures due to windage heating when the turbine is running at full speed, no load, the apparatus comprising:

the turbine comprising an inlet, and an exhaust output, a heat recovery steam generator with at least one source of producing steam having a first pressure lower than a second pressure of steam within the turbine when the turbine is experiencing windage heating when running at full speed, no load, the source of steam production being connected to the turbine inlet, and at least one flow control apparatus that is adjustable to control the flow of steam to the turbine inlet from the at least one source of steam production, the at least one apparatus being adjusted to input the first lower pressure steam into the turbine inlet to thereby create first steam conditions at the turbine inlet that are lower in pressure and temperature than second steam conditions at the turbine exhaust output to thereby reduce high steam temperatures due to windage heating at the turbine exhaust output.

2. The apparatus of claim 1, wherein the at least one source of steam production is comprised of:

a heat recovery steam generator with a plurality of pressure levels connected to the turbine inlet, and a plurality of flow control apparatuses corresponding to the plurality of heat recovery steam generator levels, each apparatus being adjustable to control the flow of steam to the turbine inlet from a corresponding heat recovery steam generator level, the plurality of flow control apparatuses being adjusted to mix steam coming from a first pressure level of the heat recovery steam generator and at least one second pressure level of the heat recovery steam generator that is lower than the first pressure level to thereby create first steam conditions at the turbine inlet that are lower in pressure and temperature than second steam conditions at the turbine exhaust output to thereby reduce high steam temperatures due to windage heating at the turbine exhaust output.

3. The apparatus of claim 1, wherein the at least one source of steam production is comprised of a single pressure level heat recovery steam generator and evaporator for producing saturated steam, and wherein the at least one flow control apparatus functions as a super heater in which the saturated steam is super heated and then input to the turbine inlet to thereby create first steam conditions at the turbine inlet that are lower in pressure and temperature than second steam conditions at the turbine exhaust output to thereby reduce high steam temperatures due to windage heating at the turbine exhaust output.

4. The apparatus of claim 1, wherein the at least one flow control apparatus is a valve that is adjustable.

5. The apparatus of claim 2, wherein the plurality of flow control apparatuses is a plurality of valves that are adjustable.

6. The apparatus of claim 2, wherein the plurality of heat recovery steam generator pressure levels includes a first pressure level that is a high pressure level.

7. The apparatus of claim 6, wherein the plurality of heat recovery steam generator pressure levels includes a second pressure level that is an intermediate pressure level.

8. The apparatus of claim 7, wherein the plurality of heat recovery steam generator pressure levels includes a third pressure level that is a low pressure level.

9. The apparatus of claim 1, wherein the turbine is comprised of two high pressure sections in a double flow configuration.

10. The apparatus of claim 9, wherein the turbine is comprised of two exhaust outputs from the two high pressure sections.

11. The apparatus of claim 2, wherein the plurality of pressure levels includes two pressure levels, and wherein the plurality of flow control apparatuses are adjusted so that steam coming from a first pressure level is shut off and steam coming from a second pressure level is received at the turbine inlet and flashed into super heated steam to thereby create first steam conditions at the turbine inlet that are lower in pressure and temperature than second steam conditions at the turbine exhaust output to thereby reduce high steam temperatures due to windage heating at the turbine exhaust output.

12. The apparatus of claim 1, wherein the heat recovery steam generator includes a high pressure level and an intermediate pressure level.

13. An apparatus for reducing, at the exhaust of a turbine, high steam temperatures due to windage heating when the turbine is running at full speed, no load, the apparatus comprising:

the turbine including a casing comprising:

an inlet, at least one high pressure section with at least one stage, and at least one exhaust output, a heat recovery steam generator with at least one source of producing steam having a first pressure lower than a second pressure of steam within the turbine when the turbine is experiencing windage heating when running at full speed, no load, the source of steam production being connected to the casing inlet, and at least one valve that is adjustable to control the flow of steam to the casing inlet from the at least one source of steam production, the at least one valve being adjusted to input the first lower pressure steam into the casing inlet to thereby create first steam conditions at the casing inlet that are lower in pressure and temperature than second steam conditions at the casing exhaust output to thereby reduce high steam temperatures due to windage heating at the casing exhaust output.

14. The apparatus of claim 13, wherein the at least one source of steam production is comprised of:

a heat recovery steam generator with a plurality of pressure levels connected to the turbine inlet, and a plurality of valves corresponding to the plurality of heat recovery steam generator levels, each valve being adjustable to control the flow of steam to the turbine inlet from a corresponding heat recovery steam generator level, the plurality of valves being adjusted to mix steam coming from a first pressure level of the heat recovery steam generator and at least one second pressure level of the heat recovery steam generator that is lower than the first pressure level to thereby create first steam conditions at the turbine inlet that are lower in pressure and temperature than second steam conditions at the turbine exhaust output to thereby reduce high steam temperatures due to windage heating at the turbine exhaust output.

15. The apparatus of claim 1, wherein the at least one source of steam production is comprised of a single pressure level heat recovery steam generator and evaporator for producing saturated steam, and wherein the at least one valve when open functions as a super heater in which the saturated steam is super heated and then input to the turbine inlet to thereby create first steam conditions at the turbine inlet that are lower in pressure and temperature than second steam conditions at the turbine exhaust output to thereby reduce high steam temperatures due to windage heating at the turbine exhaust output.

16. A method of reducing high temperatures due to windage heating at the exhaust of a turbine when the turbine is running at full speed, no load, the method comprising the steps of:

providing a turbine comprised of an inlet and an exhaust output, providing a heat recovery steam generator with at least one source of producing steam having a first pressure lower than a second pressure of steam within the turbine when the turbine is experiencing windage heating when running at full speed, no load, the source of steam production being connected to the turbine inlet, providing at least one flow control apparatus that is adjustable to control the flow of steam to the turbine inlet from the at least one source of steam production, and adjusting the at least one apparatus to input the first lower pressure steam into the turbine inlet to thereby create first steam conditions at the turbine inlet that are lower in pressure and temperature than second steam conditions at the turbine exhaust output to thereby reduce high steam temperatures due to windage heating at the turbine exhaust output.

17. The method of claim 16, wherein the at least one source of steam production is comprised of:

a heat recovery steam generator with a plurality of pressure levels connected to the turbine inlet, and a plurality of flow control apparatuses corresponding to the plurality of heat recovery steam generator levels, each apparatus being adjustable to control the flow of steam to the turbine inlet from a corresponding heat recovery steam generator level, the method further comprising the step of adjusting the plurality of flow control apparatuses to mix steam coming from a first pressure level of the heat recovery steam generator and at least one second pressure level of the heat recovery steam generator that is lower than the first pressure level to thereby create first steam conditions at the turbine inlet that are lower in pressure and temperature than second steam conditions at the turbine exhaust output to thereby reduce high steam temperatures due to windage heating at the turbine exhaust output.

18. The method of claim 16, wherein the at least one source of steam production is comprised of a single pressure level heat recovery steam generator and evaporator for producing saturated steam, and wherein the at least one flow control apparatus functions as a super heater in which the saturated steam is super heated, the method further comprising the step of inputting into the turbine inlet the super heated steam to thereby create first steam conditions at the turbine inlet that are lower in pressure and temperature than second steam conditions at the turbine exhaust output to thereby reduce high steam temperatures due to windage heating at the turbine exhaust output.

19. The method of claim 17, further comprising the steps of adjusting the plurality of valves so that steam coming from the first pressure level is shut off and steam coming from the second pressure level is received at the inlet and flashing the received steam into superheated steam to thereby create first steam conditions at the turbine inlet that are lower in pressure and temperature than second steam conditions at the turbine exhaust output to thereby reduce high steam temperatures due to windage heating at the turbine exhaust output.

20. The method of claim 17, wherein the plurality of heat recovery steam generator pressure levels includes a high pressure level, an intermediate pressure level and a low pressure level.

* * * * *

UNITED STATES PATENT AND TRADEMARK OFFICE

CERTIFICATE OF CORRECTION

PATENT NO. : 8,015,811 B2
APPLICATION NO. : 12/318956
DATED : September 13, 2011
INVENTOR(S) : Tyler et al.

It is certified that error appears in the above-identified patent and that said Letters Patent is hereby corrected as shown below:

Title page of Patent No. 8,015,811 at INID code (57), line 12 of the Abstract, delete "the HSRG evaporator" and insert --the HRSG evaporator--

At column 3, line 48, delete "temperatures windage" and insert --temperatures. Windage--

Signed and Sealed this
Twenty-fifth Day of October, 2011

David J. Kappos

David J. Kappos
*Director of the United States Patent and Trademark Office*